US006634324B1

(12) United States Patent
Mewes

(10) Patent No.: US 6,634,324 B1
(45) Date of Patent: Oct. 21, 2003

(54) DIESEL PILE HAMMER

(75) Inventor: Stefan Mewes, Esslingen (DE)

(73) Assignee: Delmag GmbH & CO, KG (DE)

( * ) Notice: Subject to any disclaimer, the term of this patent is extended or adjusted under 35 U.S.C. 154(b) by 0 days.

(21) Appl. No.: 10/112,820

(22) Filed: Mar. 29, 2002

(51) Int. Cl.[7] ..... B25D 9/00
(52) U.S. Cl. ..... 123/46 R
(58) Field of Search ..... 123/46 H, 46 R, 123/46 A, 46 SC, 46 B, 46 E, 179.31; 173/114, 208, 1, 135, 209, 2, 137, 206, 207

(56) References Cited

U.S. PATENT DOCUMENTS 6,102,133 A * 8/2000 Scheid et al. ..... 173/208

FOREIGN PATENT DOCUMENTS

RU 1390303 A * 4/1988 ..... E02D/7/12

* cited by examiner

*Primary Examiner*—Willis R. Wolfe
*Assistant Examiner*—Hyder Ali
(74) *Attorney, Agent, or Firm*—Factor & Partners

(57) ABSTRACT

In a diesel pile hammer, the circumferential surfaces of a piston and striker extend axially to such an extent that, when the piston and striker bear on one another, they are separated only by a very small distance. In their near-edge sections, the piston end face and striker end face are each provided with an annular trough having a semicircular cross section. In this way, when the piston has traveled fully against the striker, a basic working space is obtained, having the form of an annular space with a circular cross-section, in which combustion commences.

11 Claims, 2 Drawing Sheets

DIESEL PILE HAMMER

The invention concerns a diesel pile hammer according to the pre-characterizing clause of claim 1.

In the case of such diesel pile hammers, the combustion fuel is injected, through an injection nozzle carried by the cylinder, into a fuel trough fashioned centrally in the piston-side end face of the striker. The opposing end face of the piston is graduated towards the edge, in steps, away from the striker. Fuel which is atomized when the piston impacts on the striker thus reaches the cylinder sliding surface. This portion of the fuel is to a large extent lost in respect of the actual combustion process.

SUMMARY OF THE INVENTION

The object of the present invention is to develop a diesel pile hammer according to the pre-characterizing clause of claim 1 so as to improve utilization of the fuel.

This object is achieved, according to the invention, by a diesel pile hammer according to claim 1.

In the case of the diesel pile hammer according to the invention, the piston circumferential surface extends essentially just as far in the axial direction towards the striker as the end face of the piston. This piston itself thus largely covers the cylinder sliding surface. The fuel which is atomized when the piston impacts on the striker reaches the piston end face, where it is available for the combustion process, and not the cylinder sliding surface.

Advantageous developments of the invention are disclosed by the sub-claims.

The development of the invention according to claim 1 is advantageous in further improving the availability for combustion of the fuel collected by the piston end face, since the annular trough in the piston end face, disclosed in claim 1, results in flows, as the piston end face approaches the striker end face, which distribute the fuel in the combustion air.

The development of the invention according to claim 2 results in a further improved covering of the cylinder sliding surface, by means of the striker.

If an annular trough is also provided in the striker end face, as disclosed in claim 3, fuel which has collected in the corresponding regions of the striker end face is supplied to combustion in a particularly effective manner due to air flows.

In the case of a diesel pile hammer according to claim 4, the annular troughs of the piston and striker together form an annular space in which there can develop annular air cylinders by which fuel collected in the corresponding end face regions is again supplied to the combustion air.

The geometry of the annular troughs disclosed in claim 5 is particularly advantageous for the development of toroidal flow cylinders.

The development of the invention according to claims 6 to 8 achieves the result that even portions of fuel which are essentially flung away, in the direction perpendicular to the cylinder axis, when the piston end face impacts on the striker end face, do not reach the cylinder sliding surface since they are arrested by the outermost end section of the striker circumferential wall (or, in the case of a projecting end face section of the striker, are analogously arrested by the piston circumferential wall).

The annular trough dimensions stated in claim 9 have proved, in particular, to be highly effective in respect of the fuel combustion.

The development of the invention according to claim 10 achieves the result that, when the piston end face impacts on the striker end face, the fuel can be suitably distributed in the angular and radial directions, the piston-side end face of the striker nevertheless being curved only to such a small extent, however, that fuel injected on to it remains there, without running off.

The development of the invention according to claim 11 likewise promotes the atomization of the fuel in the radial and circumferential directions, in a uniform manner.

BRIEF DESCRIPTION OF THE DRAWINGS

The invention is explained more fully below with the aid of an embodiment example and with reference to the drawing, wherein.

DETAILED DESCRIPTION OF THE DRAWINGS

Figure 1:
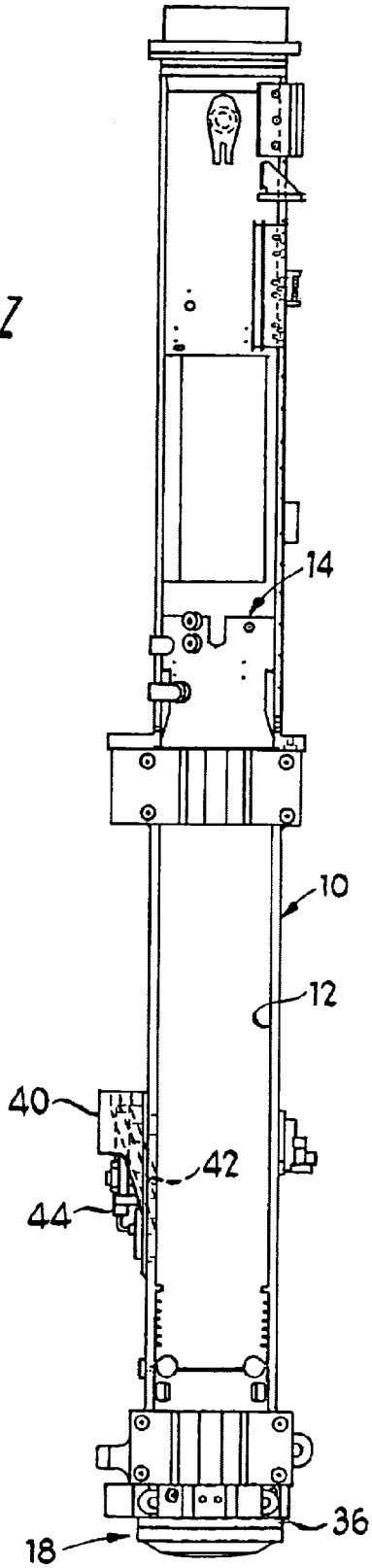
FIG. 1: shows a side view of a diesel pile hammer.

The diesel pile hammer shown in the drawing has a cylinder, denoted by 10, which has a cylinder sliding surface 12. Extending in the cylinder 10 is a piston 14, which is of along length in comparison with the cylinder diameter. At its lower end, this piston carries several axially separated sealing rings 16.

Extending in the lower section of the cylinder 10 is a striker, denoted as a whole by 18, which comprises an upper piston section 20 carrying a plurality of axially separated sealing rings 22 which work together with the cylinder sliding surface 12, a central shaft section 24 and a lower head section 26.

The head section 26 has a slightly convex lower end face 28 which works together, directly or via a striker, not shown, with pile-driving material (steel sheet pile or concrete pile) which is to be driven into the ground.

The shaft section 24 extends in a cylinder end piece 30 which is connected, through a plurality of circumferentially distributed screws 32, to the lower end of the cylinder 10. The sealing between the cylinder end piece 30 and the outside surface of the shaft section 24 is provided by several sealing rings 34, which are carried by the inside surface of the cylinder end piece 30. A first damping ring 36 is disposed between the upper end face of the head section 26 and the lower end face of the cylinder end piece 30; a second damping ring 38 then becomes active when the underside of the piston section 20 is moved towards the top side of the cylinder end piece 30.

The cylinder 10 has a radial projection 40 in which there is fashioned a working channel 42 via which combustion air is taken in out of the environment and combustion gases are emitted to the environment.

Figure 2:
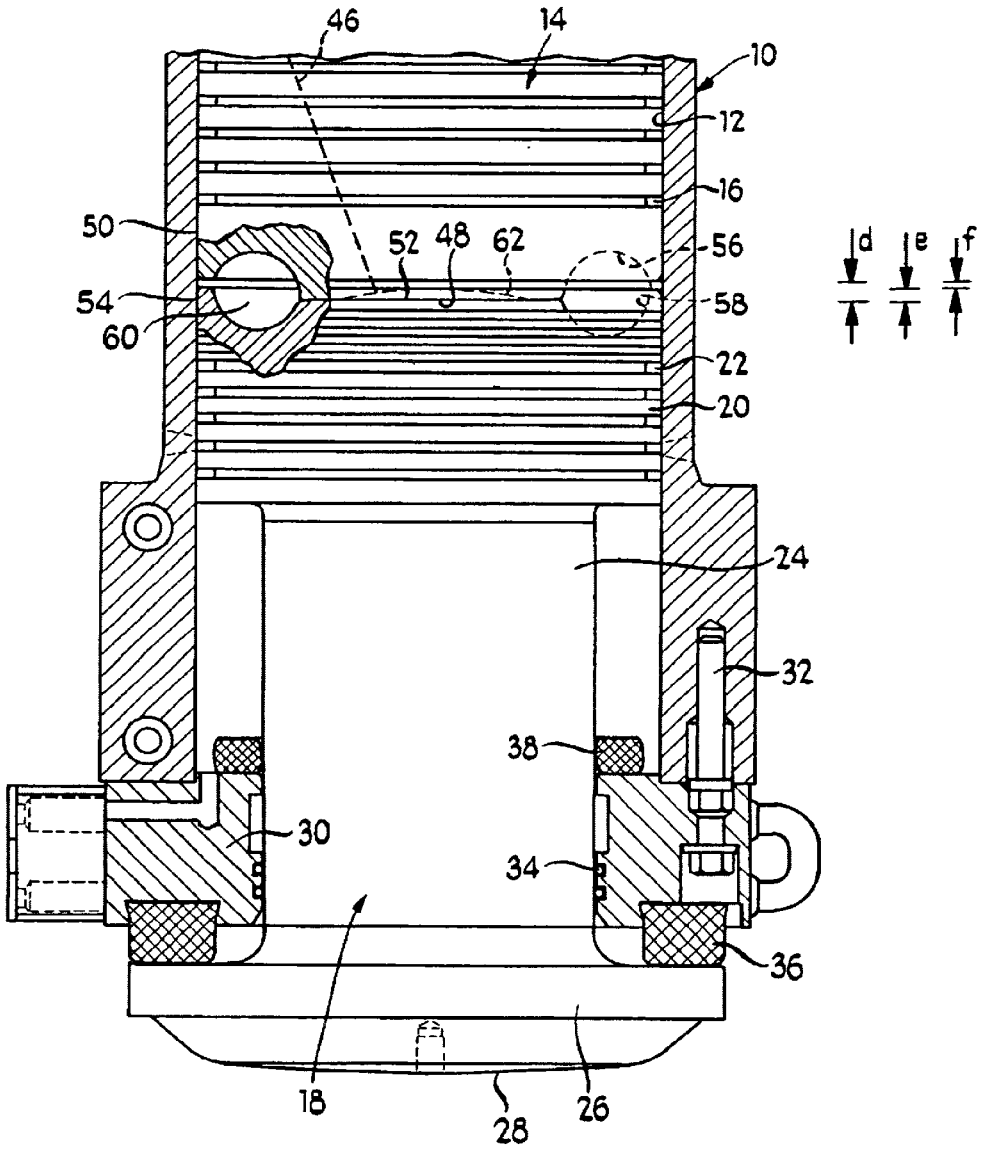
FIG. 2: shows an enlarged axial section through the lower end of the diesel pile hammer, in which details of the combustion chamber geometry are represented.

Additionally mounted on the outside of the cylinder 10 is an injection pump 44 which is actuated by means of a ram, not shown in the drawing, when the piston 14 drops, and which directs a fuel jet, indicated schematically in FIG. 2 by 46, towards the upper end face of the striker 18, via injection nozzles which are not shown in detail in the drawing.

As evident from FIG. 2, in particular, a central section 48 of the striker-side end face of the piston 14 extends by a small distance, d, beyond the transverse plane which is defined by the edge of the circumferential surface, denoted by 50, of the piston 14. A central section 52 of the piston-side end face of the striker 18 is offset down or back by a small distance e relative to the transverse plane which is defined by the edge of the circumferential surface 54 of the striker.

As shown by the drawing, the distance, d, is made somewhat larger than the distance e, so that, when the piston 14 has traveled fully against the striker 1 8, a small distance, f, remains between the adjacent edges of the circumferential surfaces 50 and 54.

Provided between the central section 48 of the striker-side end face of the piston 14 and the lower edge of the circumferential surface 50 of the piston 14 is an annular trough 56 which has an essentially semicircular cross section (apart from the asymmetry resulting from the offset of the central end face section 48 by the small distanced).

Similarly, located between the central section 52 of the piston-side end face of the striker 18 and the upper edge of the circumferential surface 54 of the striker 18 is an annular trough 58 which, likewise, has a substantially semicircular cross section (apart from the slight asymmetry resulting from the offset e of the central section 52 of the striker end face).

As viewed in the axial direction, the two annular troughs 56 and 58 are in alignment and thus together delimit an annular space 60 having a substantially circular cross section.

The central sections 48 and 52 of the piston end face and striker end face are each convexly curved with a radius which is large in comparison with the diameter of the piston 12 or the striker 18. In practice, with an inside diameter of the cylinder 14 of approximately 300 mm, the radii of curvature of the central end face sections 48 and 52 can be approximately 600 mm.

The large radius of curvature of the central end face sections 48 and 52 ensures that fuel reaching these end face sections remains substantially in place and is not redistributed due to the effect of gravity. Provision must then be made such that the cycle times between the injection of the fuel and the striking of the piston 14 on the striker 18 are only short.

The injection of the fuel on to the central end face section 52 of the striker 18 results in a pool of fuel which is distributed about the axis of the striker, as denoted schematically by 62. When the central end face section 48 of the piston 14 impacts on the central end face section 52 of the striker 18, the pool of fuel 62 is atomized in the radial direction and (due to the slight curvature of the end face sections 48 and 50) slightly in the axial direction. However, the axial opening cone of the thus obtained fuel spray disc is so small that the fuel spray disc still remains substantially within the axial extent of the annular trough 58. Due to the smallness of the distance f, only a very small portion of the fuel spray can reach the cylinder sliding surface, even in the case of a larger opening angle of the fuel spray disc.

Due to the circular toroidal geometry of the annular space 60, an annular cylinder of ignitable mixture can form in the latter, this promoting uniform and complete combustion of the ignitable mixture.

As a variation, the end face section 52 can be made to project upwards by a distance d over the edge of the circumferential surface 54 and the end face section 48 can be offset up or back by a distance e from the plane of the lower edge of the circumferential surface 50.

In the case of such a diesel pile hammer, likewise, the circumferential surfaces 50, 54 of the piston 14 and striker 18 extend axially to such an extent that, when the piston 14 and striker 18 bear on one another, they are separated only by the very small distance f. In their near-edge sections, the piston end face and striker end face are each again provided with the annular trough 56, 58 having a semicircular cross section. In this way, when the piston 14 has traveled fully against the striker 18, a basic working space is again obtained, having the form of an annular space 60 with a circular cross-section, in which combustion commences.

What is claimed is:

1. Diesel pile hammer with a cylinder having a working channel, a piston extending in the cylinder and a striker extending in the lower cylinder section, the cylinder, piston and striker delimiting a working space, with an injection device for the intermittent injection of fuel into the working space, a fuel trough being fashioned in the piston-side end face of the striker, characterized in that the circumferential surface of the piston extends, at least in its striker-side end section, to an axial location which corresponds essentially to the axial position of the striker-side end face of the piston, wherein the striker-side end face of the piston has an eccentric annular trough located radially within the circumferential surface of the piston, and close to the circumferential surfaces of the piston and the striker.

2. The diesel pile hammer according to claim 1, characterized in that the circumferential surface of the striker extends, at least in its section adjacent to the piston, to an axial position which corresponds essentially to the axial position of the piston-side end face of the striker.

3. The diesel pile hammer according to claim 2, characterized in that the piston-side end face of the striker has an eccentric annular trough located radially within the circumferential surface of the striker.

4. The diesel pile hammer according to claim 3, characterized in that, as viewed in the axial direction, the annular troughs of the piston and striker are in alignment and the striker-side end face of the piston has an eccentric annular trough located radially within the circumferential surface of the piston.

5. The diesel pile hammer according to claim 4, characterized in that the annular troughs of the piston and striker define an annular space which has a substantially circular cross section.

6. The diesel pile hammer according to claim 5, characterized in that a central section of the piston-side end face of the striker is located at a distance, which is small in comparison with the piston diameter, behind the piston-side axial end of the circumferential surface of the striker, this small distance preferably being approximately 2% to 4% of the diameter of the striker.

7. The diesel pile hammer according to claim 1, characterized in that the central section of the striker-side end face of the piston is located at a distance, which is small in comparison with the piston diameter, in front of the striker-side axial end of the piston circumferential surface, this small distance preferably being 3% to 5% of the piston diameter.

8. The diesel pile hammer according to claim 7, characterized in that the small distance by which the central section of the striker-side end face of the piston is offset back from the striker-side axial end of the piston circumferential surface is greater than the small distance by which the central section of the piston-side end face of the striker is located behind the piston-side axial end of the striker circumferential surface and the central section of the piston-side end face of the striker is located at a distance, which is small in comparison with the piston diameter, behind the piston-side axial end of the circumferential surface of the striker, this small distance preferably being approximately 2% to 4% of the diameter of the striker.

9. The diesel pile hammer according to claim 1, characterized in that the inside diameter of the annular troughs corresponds to approximately 50% to 65%, preferably approximately 57%, of the outside diameter of the piston or the striker.

10. The diesel pile hammer according to claim 1, characterized in that the piston-side end face of the striker is convexly curved with a radius of curvature which is large in comparison with the striker diameter.

11. The diesel pile hammer according to claim 1, characterized in that the striker-side end face of the piston is convexly curved with a radius of curvature which is large in comparison with the piston diameter.

* * * * *

UNITED STATES PATENT AND TRADEMARK OFFICE

CERTIFICATE OF CORRECTION

PATENT NO. : 6,634,324 B1
DATED : October 21, 2003
INVENTOR(S) : Mewes

It is certified that error appears in the above-identified patent and that said Letters Patent is hereby corrected as shown below:

Column 4,
Line 31, after the word "alignment" insert -- . -- and delete "and the stricker-side end face of the piston has an eccentric annular trough located radially within the circumferential surface of the piston."
Line 60, after the word "surface" insert -- . -- and delete "and the central section of the piston-side end face of the striker is located at a distance, which is small in comparison with the piston diameter, behind the piston-side axial end of the circumferential surface of the striker, this small distance preferably being approximately 2% to 4% of the diameter of the striker."

Signed and Sealed this

Ninth Day of March, 2004

JON W. DUDAS
*Acting Director of the United States Patent and Trademark Office*